US009993919B2

(12) United States Patent
Chen

(10) Patent No.: US 9,993,919 B2
(45) Date of Patent: Jun. 12, 2018

(54) TOOLBOX

(71) Applicant: A-TINA TOOLS CO., LTD., Taichung (TW)

(72) Inventor: Kun-Chen Chen, Taichung (TW)

(73) Assignee: A-Tina Tools Co., Ltd., Taichung (TW)

( * ) Notice: Subject to any disclaimer, the term of this patent is extended or adjusted under 35 U.S.C. 154(b) by 205 days.

(21) Appl. No.: 14/936,763

(22) Filed: Nov. 10, 2015

(65) Prior Publication Data

US 2017/0129096 A1 May 11, 2017

(51) Int. Cl.

| | |
|---|---|
| ***B25H 3/02*** | (2006.01) |
| *B65D 1/48* | (2006.01) |
| *B65D 1/42* | (2006.01) |

(52) U.S. Cl.

CPC ..... *B25H 3/02* (2013.01); *B65D 1/42* (2013.01); *B65D 1/48* (2013.01)

(58) Field of Classification Search

CPC ..... B25H 3/02; B65D 3/30; B65D 55/0845; B65D 1/48; B65D 1/42

See application file for complete search history.

(56) References Cited

U.S. PATENT DOCUMENTS 1,926,162 A * 9/1933 Moberly ..... A01K 97/06 206/315.11
3,441,071 A * 4/1969 Confer ..... B29C 49/0031 190/119
3,795,265 A * 3/1974 Schurman ..... B29C 49/0031 206/521
3,822,083 A * 7/1974 Zeamer ..... B41J 29/13 312/208.4
4,522,312 A * 6/1985 Rathgeber ..... A45C 13/1084 220/324
4,615,464 A * 10/1986 Byrns ..... B29C 49/0031 16/341
4,703,853 A * 11/1987 Byrns ..... G11B 23/0233 206/387.13
5,601,206 A * 2/1997 Haas ..... B60R 9/00 16/254
6,109,437 A * 8/2000 Chao ..... B25H 3/06 206/303

(Continued)

*Primary Examiner* — Anthony Stashick
*Assistant Examiner* — James Way
(74) *Attorney, Agent, or Firm* — Alan D. Kamrath; Kamrath IP Lawfirm, P.A.

(57) ABSTRACT

A toolbox has a casing and a cover. The casing has a top mounting flange, a first strengthening frame, and at least one engaging ring. The top mounting flange is formed on the casing. The first strengthening frame is mounted around the top mounting flange. The at least one engaging ring is mounted on the casing and has multiple ring fasteners mounted through the engaging ring and the top mounting flange via the first strengthening frame. The cover is connected to the casing and has a bottom mounting flange, a second strengthening frame, at least one engaging protrusion. The bottom mounting flange is formed on the cover. The second strengthening frame is mounted around the bottom mounting flange. The at least one engaging protrusion is mounted on the cover and has multiple protrusion fasteners mounted through the engaging protrusion and the bottom mounting flange via the second strengthening frame.

18 Claims, 6 Drawing Sheets

(56) References Cited

U.S. PATENT DOCUMENTS

| | | | | |
|---|---|---|---|---|
| 2006/0201833 | A1* | 9/2006 | Chen | A45C 13/08<br>206/349 |
| 2014/0265197 | A1* | 9/2014 | Russell | B25H 3/02<br>280/79.3 |
| 2015/0352711 | A1* | 12/2015 | Brunner | B25H 3/02<br>206/349 |
| 2016/0183651 | A1* | 6/2016 | Tonelli | A45C 5/03<br>190/18 A |
| 2016/0290013 | A1* | 10/2016 | Lin | E05B 65/52 |
| 2016/0346915 | A1* | 12/2016 | Lin | B25H 3/02 |
| 2017/0129097 | A1* | 5/2017 | Engvall | B25H 3/02 |

* cited by examiner

TOOLBOX

BACKGROUND OF THE INVENTION

1. Field of the Invention

The present invention relates to a toolbox which is made by a blow molding method, and more particularly to a toolbox that may increase the structural strength and extend the life of the toolbox.

2. Description of Related Art

A conventional toolbox is used to store objects such as handheld tools and has a casing and a cover. The cover is pivotally connected to the casing to selectively cover the casing, and this may form a receiving space between the casing and the cover to store the handheld tools. In addition, the conventional toolbox may be made of wood or metal. The wooden toolbox may be inconvenient for manufacturing and prone to wear after using, and this may increase the cost of manufacturing and using the wooden toolbox. Although the metal toolbox may reduce wear after using, the metal toolbox has a certain weight, and this may increase the difficulty of transportation. Therefore, a plastic toolbox may be formed in a mold by a blow molding method, and this may be convenient and time-saving for manufacturing. The casing and the cover of the plastic toolbox respectively have an internal hollow structure to reduce the overall weight of the plastic toolbox and this is convenient in carriage. Consequently, the blow molding method has become one of the common options for manufacturing toolboxes.

Although the plastic toolbox can be made conveniently by the blow molding method and easy to carry, the plastic toolbox has multiple locking elements mounted on the casing and the cover, and the locking elements that are mounted on the casing engage the locking elements that are mounted on the cover. Then, the cover is locked with the casing of the plastic toolbox. However, the casing and the cover of the plastic toolbox are respectively internally hollow structures, and each one of the locking elements is mounted on an external surface of the casing or the cover by extending through the external surface and an internal surface of the casing or the cover. When a user stores multiple handheld tools in the plastic toolbox and holds a handle of the cover to carry the handheld tools with the plastic toolbox, the casing and the cover of the plastic toolbox may be deformed at positions of the locking elements by the weight of the handheld tools since the structural strength between the locking elements of the casing and the cover are insufficient. Furthermore, the locking elements may be separated from the casing or the cover of the plastic toolbox by the deformation of the toolbox after a long time. Then the life of the plastic toolbox will be shortened by the insufficient structural strength of the plastic toolbox.

To overcome the shortcomings, the present invention provides a toolbox to mitigate or obviate the aforementioned problems.

SUMMARY OF THE INVENTION

The main objective of the present invention is to provide a toolbox which is made by a blow molding method, and more particularly to a toolbox that may increase the structural strength and extend the life of the toolbox.

The toolbox has a casing and a cover. The casing has a top mounting flange, a first strengthening frame, and at least one engaging ring. The top mounting flange is formed on the casing. The first strengthening frame is mounted around the top mounting flange. The at least one engaging ring is mounted on the casing and has multiple ring fasteners mounted through the engaging ring and the top mounting flange via the first strengthening frame. The cover is connected to the casing and has a bottom mounting flange, a second strengthening frame, and at least one engaging protrusion. The bottom mounting flange is formed on the cover. The second strengthening frame is mounted around the bottom mounting flange. The at least one engaging protrusion is mounted on the cover and has multiple protrusion fasteners mounted through the engaging protrusion and the bottom mounting flange via the second strengthening frame.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
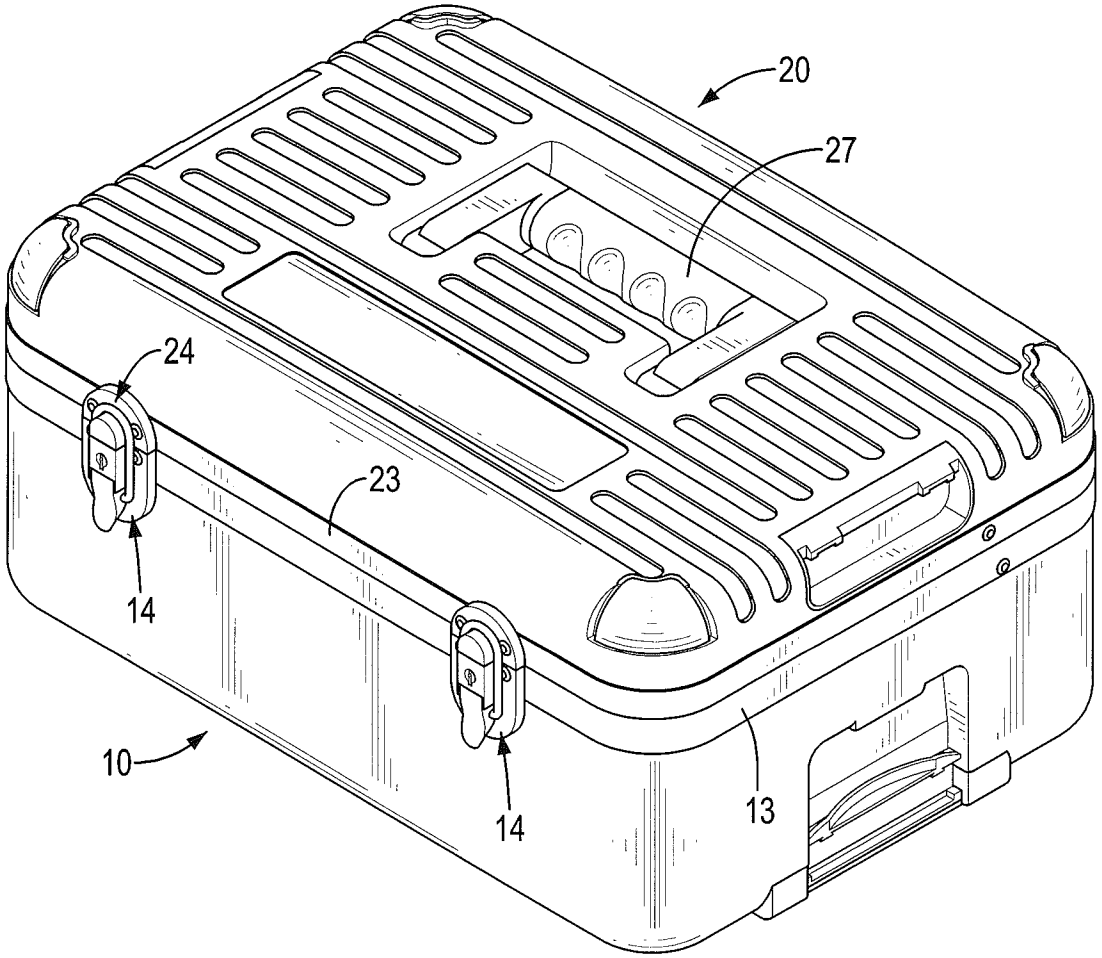
FIG. 1 is a front perspective view of a toolbox in accordance with the present invention.
Figure 2:
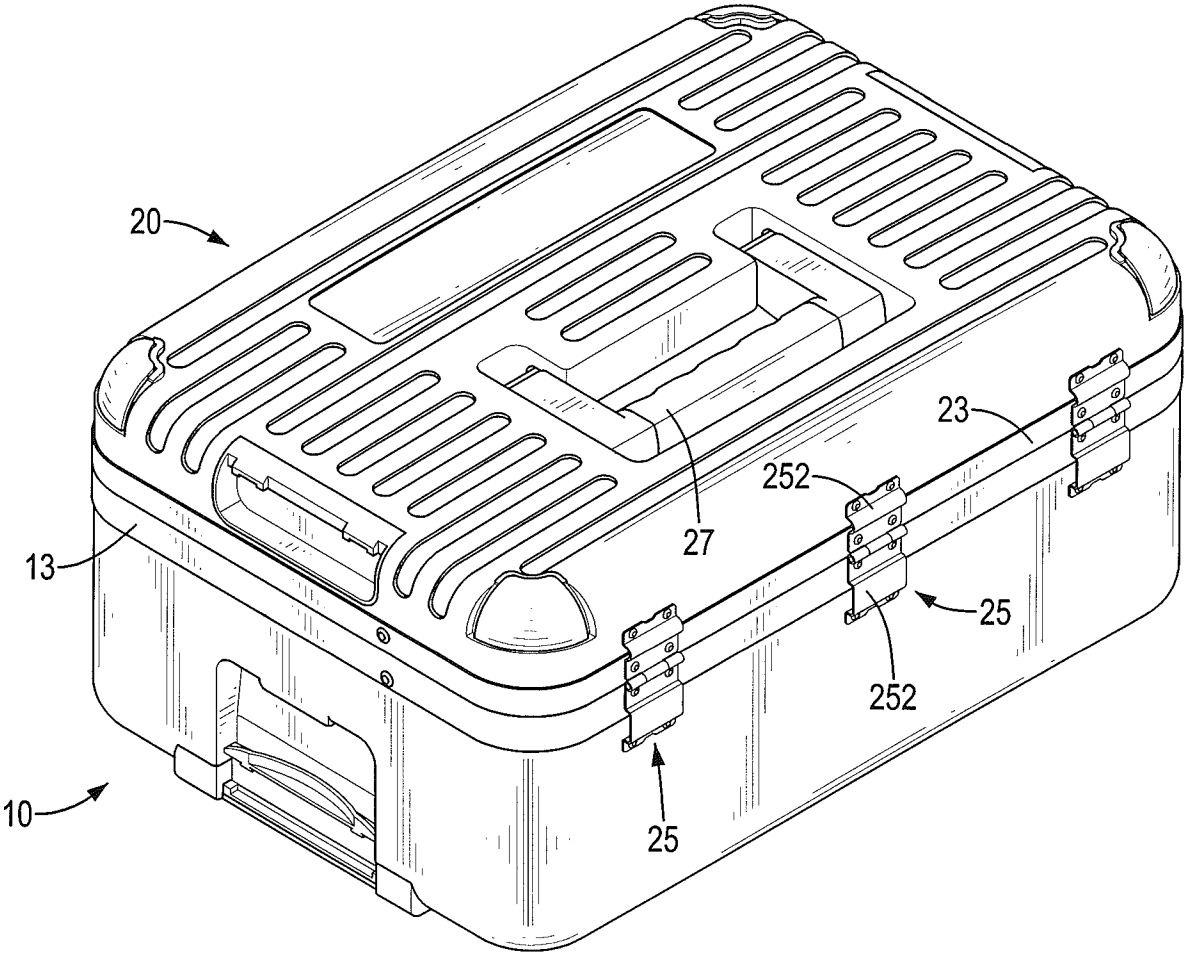
FIG. 2 is a rear perspective view of the toolbox in FIG. 1.

With reference to FIGS. 1 and 2, a toolbox in accordance with the present invention is made of plastics by a blow molding method and comprises a casing 10 and a cover 20.

Figure 3:
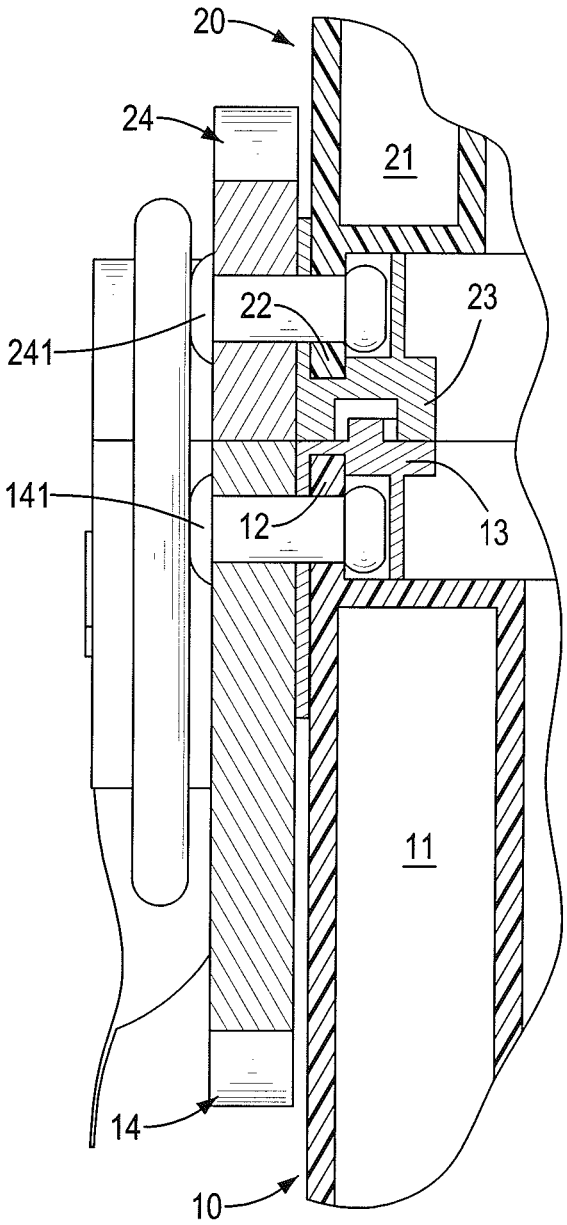
FIG. 3 is an enlarged side view in partial section of the toolbox in FIG. 1.
Figure 4:
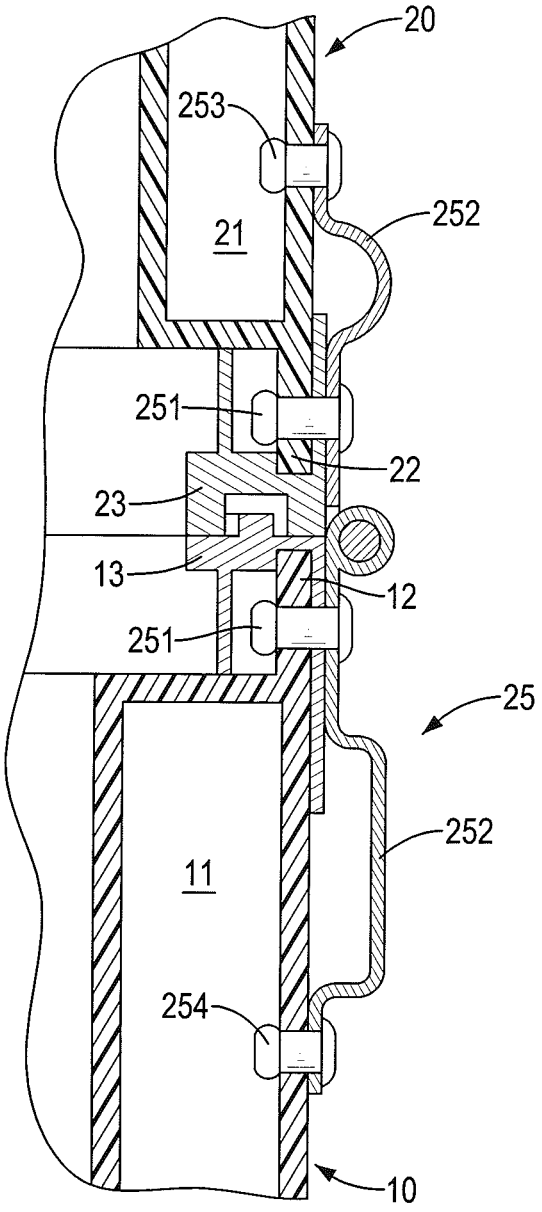
FIG. 4 is an enlarged side view in partial section of the toolbox in FIG. 2.

With further reference to FIGS. 3 and 4, the casing 10 has an external surface, an internal surface, a front side, a rear side, two opposite sides, a top side, a top opening, a forming space 11, a top mounting flange 12, a first strengthening frame 13, and at least one engaging ring 14. The opposite sides of the casing 10 are formed with the front side and the rear side of the casing 10 and face to each other. The top opening is formed through the top side of the casing 10 between the front side, the rear side, and the two opposite sides of the casing 10. The forming space 11 is a closed space and is formed in the casing 10 between the internal surface and the external surface of the casing 10 by the blow molding method.

Figure 5:
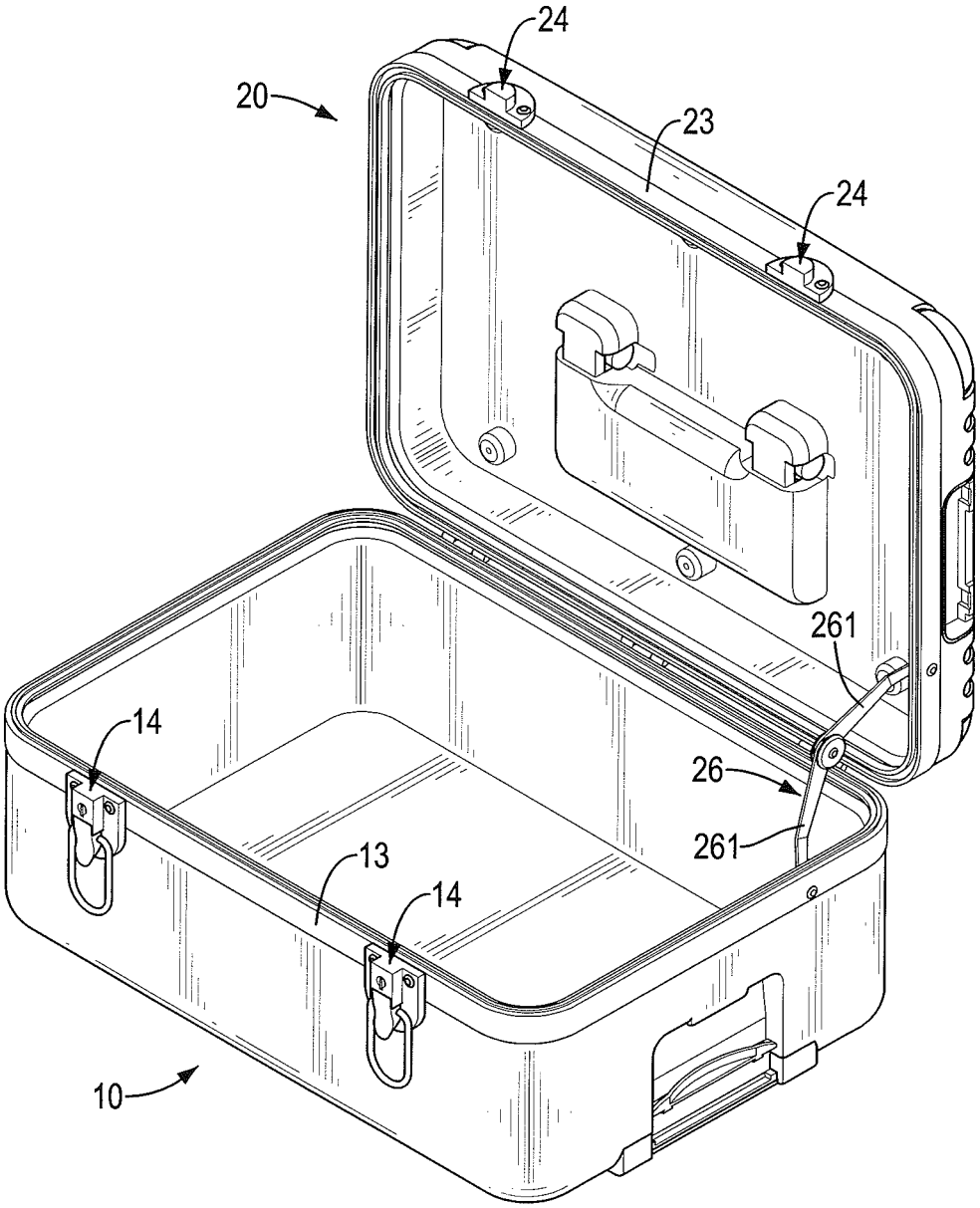
FIG. 5 is an operational perspective view of the toolbox in FIG. 1.

The top mounting flange 12 is annularly formed on and protrudes upwardly from the external surface of the casing 10 entirely around the top opening of the casing 10. The first strengthening frame 13 is annular, is entirely mounted around the top mounting flange 12 to form a closed shape as shown in FIG. 5 and abuts the external surface of the casing 10. Furthermore, the first strengthening frame 13 may be made of metal such as aluminum, and this may increase the structural strength of the casing 10. The at least one engaging ring 14 is securely mounted on the front side of the casing 10 adjacent to the top opening of the casing 10. The at least one engaging ring 14 has multiple ring fasteners 141. The ring fasteners 141 are mounted through the at least one engaging ring 14 and the top mounting flange 12 via the first strengthening frame 13 to connect the at least one engaging ring 14 securely with the first strengthening frame 13 and the top mounting flange 12 at the front side of the casing 10. In addition, the casing 10 has two engaging rings 14 securely mounted on the front side of the casing 10 at a spaced interval.

The cover 20 is pivotally connected to the casing 10 and has an external surface, an internal surface, a front side, a rear side, two opposite sides, a bottom side, a top side, a bottom opening, a forming space 21, a bottom mounting flange 22, a second strengthening frame 23, at least one engaging protrusion 24, multiple connecting hinges 25, a supporting element 26, and a handle 27. The opposite sides of the cover 20 are formed with the front side and the rear side of the cover 20 and face to each other. The bottom opening is formed through the bottom side of the cover 20 between the front side, the rear side, and the two opposite sides of the cover 20, and is corresponding in position to the top opening of the casing 10. The forming space 21 is a closed space and is formed in the cover 20 between the internal surface and the external surface of the cover 20 by the blow molding method.

The bottom mounting flange 22 is annularly formed on and protrudes downwardly from the external surface of the cover 20 entirely around the bottom opening of the cover 20. The second strengthening frame 23 is annular, is entirely mounted around the bottom mounting flange 22 to form a closed shape as shown in FIG. 5 and abuts the external surface of the cover 20. Furthermore, the second strengthening frame 23 may be made of metal such as aluminum, and this may increase the structural strength of the cover 20. The at least one engaging protrusion 24 is securely mounted on the front side of the cover 20 adjacent to the bottom opening of the cover 20, and selectively engages with the at least one engaging ring 14 when the cover 20 covers the casing 10. The at least one engaging protrusion 24 has multiple protrusion fasteners 241. The protrusion fasteners 241 are mounted through the at least one engaging protrusion 24 and the bottom mounting flange 22 via the second strengthening frame 23 to connect the at least one engaging protrusion 24 securely with the second strengthening frame 23 and the bottom mounting flange 22 at the front side of the cover 20.

Furthermore, the cover 20 has two engaging protrusions 24 securely mounted on the front side of the cover 20 at a spaced interval and respectively and selectively engaging with the two engaging rings 14 of the casing 10 to hold the cover 20 securely with the casing 10 to close the top opening of the casing 10 and the bottom opening of the cover 20.

With reference to FIG. 4, the multiple connecting hinges 25 are connected to the cover 20 and the casing 10 at the rear sides of the casing 10 and the cover 20 to enable the cover 20 to rotate pivotally relative to the casing 10. Each one of the multiple connecting hinges 25 has a middle segment, a top segment, a bottom segment, multiple hinge fasteners 251, two reinforcing sheets 252, multiple top fixing elements 253, and multiple bottom fixing elements 254. The middle segment of the connecting hinge 25 is pivotable and abuts the first strengthening frame 13 and the second strengthening frame 23 at the rear sides of the casing 10 and the cover 20.

Some of the multiple hinge fasteners 251 are mounted through the middle segment of the connecting hinge 25 and the top mounting flange 12 via the first strengthening frame 13 to connect the middle segment of the connecting hinge 25 securely with the first strengthening frame 13 and the top mounting flange 12 at the rear side of the casing 10, and the others of the multiple hinge fasteners 251 are mounted through the middle segment of the connecting hinge 25 and the bottom mounting flange 22 via the second strengthening frame 23 to connect the middle segment of the connecting hinge 25 securely with the second strengthening frame 23 and the bottom mounting flange 22 at the rear side of the cover 20.

The bottom segment and the top segment of the connecting hinge 25 are formed with the middle segment of the connecting hinge 25 respectively at the rear sides of the casing 10 and the cover 20. The two reinforcing sheets 252 are respectively formed on the bottom segment and the top segment of the connecting hinge 25 and respectively abut the rear sides of the casing 10 and the cover 20. The top fixing elements 253 are mounted through the reinforcing sheet 252 that abuts the rear side of the cover 20 and are connected to the rear side of the cover 20. The bottom fixing elements 254 are mounted through the reinforcing sheet 252 that abuts the rear side of the casing 10 and are connected to the rear side of the casing 10. Additionally, each one of the ring fasteners 141, the protrusion fasteners 241, the top fixing elements 253, and the bottom fixing elements 254 may be a rivet.

Figure 6:
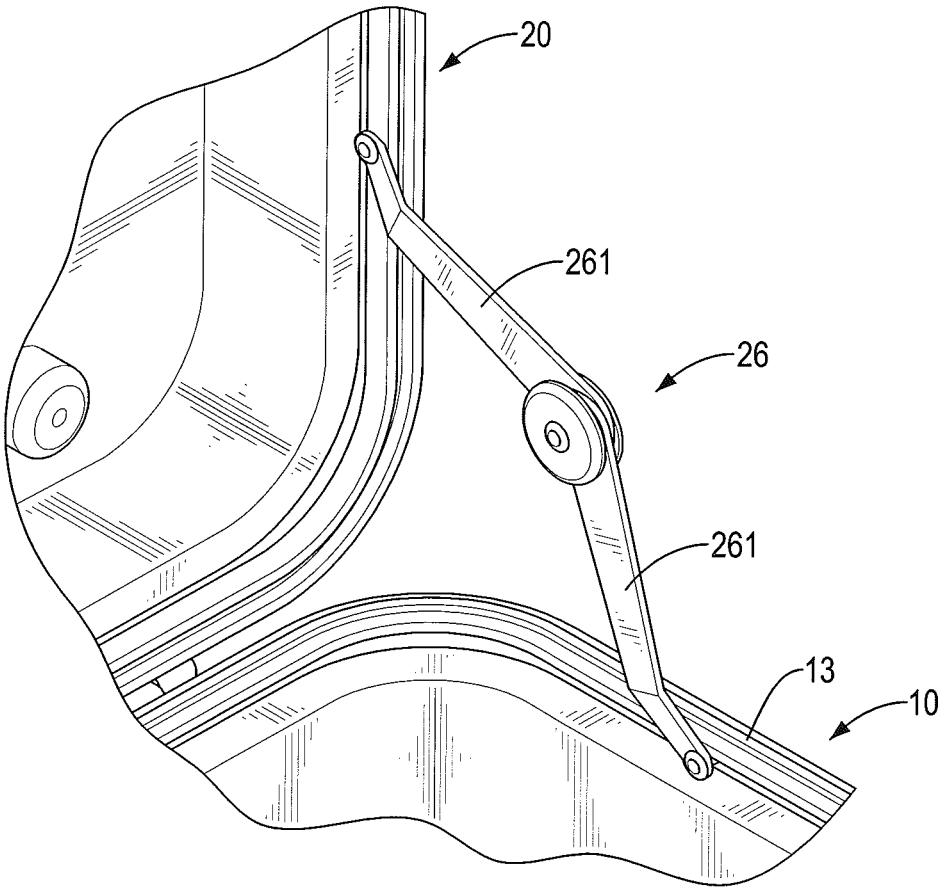
FIG. 6 is an enlarged and operational perspective view of the toolbox in FIG. 5.

With reference to FIGS. 5 and 6, the supporting element 26 is connected to the first strengthening frame 13 and the second strengthening frame 23 to provide a supporting effect to the cover 20 relative to the casing 10, and has two connecting arms 261. The two connecting arms 261 are pivotably connected to each other, and one of the two connecting arms 261 is connected to the first strengthening frame 13 at one of the opposite sides of the casing 10, and the other one of the connecting arms 261 is connected to the second strengthening frame 23 at one of the opposite sides of the cover 20 that is corresponding to said one of the opposite sides of the casing 10. The handle 27 is pivotally mounted on the top side of the cover 20.

In use, with reference to FIGS. 1 and 2, after disengaging the engaging protrusions 24 of the cover 20 from the engaging rings 14 of the casing 10, the cover 20 is pivoted relative to the casing 10 via the connecting hinges 25. With reference to FIGS. 5 and 6, the two connecting arms 261 of the supporting element 26 provide a supporting effect to the cover 20 relative to the casing 10 to hold the cover 20 over the casing 10. Then, a user can put and store handheld tools in the casing 10, and close the cover 20 on the casing 10. After the engaging rings 14 respectively engage the engaging protrusions 24 again, the user can carry the handheld tools with the toolbox by holding the handle 27 of the cover 20.

With reference to FIGS. 3 and 4, the first strengthening frame 13 and the second strengthening frame 23 respectively increase the structural strengths of the casing 10 and the cover 20, and the engaging rings 14 and the engaging protrusions 24 are securely and respectively mounted on the casing 10 and the cover 20 by the ring fasteners 141 mounted through the engaging rings 14 and the top mounting flange 12 via the first strengthening frame 13 to connect the engaging rings 14 securely with the first strengthening frame 13 and the top mounting flange 12 at the front side of the casing 10, and by the protrusion fasteners 241 mounted through the engaging protrusion 24 and the bottom mounting flange 22 via the second strengthening frame 23 to connect the engaging protrusion 24 securely with the second strengthening frame 23 and the bottom mounting flange 22 at the front side of the cover 20.

Additionally, the middle segment of each one of the multiple connecting hinges 25 is connected to the casing 10 and the cover 20 respectively via the first strengthening frame 13 and the second strengthening frame 23. Then, when the user holds the toolbox, the two strengthening frames 13, 23 can increase the structural strength of the toolbox and maintain the shapes of the casing 10 and the cover 20 to prevent the toolbox from deforming when the user holds the toolbox with the handheld tools. Furthermore, the engaging rings 14 and the engaging protrusions 24 are respectively connected to the casing 10 and the cover 20 via the two strengthening frames 13, 23 without directly connecting to the casing 10 and the cover 20 with the forming spaces 11, 21. The engaging rings 14 and the engaging protrusions 24 can be securely and respectively connected to the casing 10 and the cover 20 without separating from the casing 10 and the cover 20 after a long time of use. In addition, the middle segment of each one of the multiple connecting hinges 25 is connected to the casing 10 and the cover 20 via the two strengthening frames 13, 23, and this also can increase the structural strength of the toolbox. Consequently, the structural strength of the toolbox can be improved by the above-mentioned features, and the life of the toolbox also can be longer than the conventional plastic toolbox.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A toolbox having:

a casing having an external surface;

an internal surface;

a front side;

a rear side;

two opposite sides formed with the front side and the rear side of the casing and facing to each other;

a top side;

a top opening formed through the top side of the casing between the front side, the rear side, and the two opposite sides of the casing;

a forming space being a closed space and formed in the casing between the internal surface and the external surface of the casing;

a top mounting flange annularly formed on and protruding upwardly from the external surface of the casing entirely around the top opening of the casing;

a first strengthening frame being annular, entirely mounted around the top mounting flange to form a closed shape, and abutting the external surface of the casing; and at least one engaging ring securely mounted on the front side of the casing adjacent to the top opening of the casing and having multiple ring fasteners mounted through the at least one engaging ring and the top mounting flange via the first strengthening frame to connect the at least one engaging ring securely with the first strengthening frame and the top mounting flange at the front side of the casing; and a cover pivotally connected to the casing and having an external surface;

an internal surface;

a front side;

a rear side;

two opposite sides formed with the front side and the rear side of the cover and facing to each other;

a bottom side;

a bottom opening formed through the bottom side of the cover between the front side, the rear side, and the two opposite sides of the cover, and corresponding in position to the top opening of the casing;

a forming space being a closed space and formed in the cover between the internal surface and the external surface of the cover;

a bottom mounting flange being annularly formed on and protruding downwardly from the external surface of the cover entirely around the bottom opening of the cover;

a second strengthening frame being annular, entirely mounted around the bottom mounting flange to form a closed shape, and abutting the external surface of the cover; and at least one engaging protrusion securely mounted on the front side of the cover adjacent to the bottom opening of the cover, selectively engaging with the at least one engaging ring when the cover covers the casing, and having multiple protrusion fasteners mounted through the at least one engaging protrusion and the bottom mounting flange via the second strengthening frame to connect the at least one engaging protrusion securely with the second strengthening frame and the bottom mounting flange at the front side of the cover.

2. The toolbox as claimed in claim 1, wherein the cover has multiple connecting hinges connected to the cover and the casing at the rear sides of the casing and the cover to enable the cover to rotate pivotally relative to the casing, and each one of the multiple connecting hinges has a middle segment being pivotable and abutting the first strengthening frame and the second strengthening frame at the rear sides of the casing and the cover; and multiple hinge fasteners, some of the multiple hinge fasteners mounted through the middle segment of the connecting hinge and the top mounting flange via the first strengthening frame to connect the middle segment of the connecting hinge securely with the first strengthening frame and the top mounting flange at the rear side of the casing, and the others of the multiple hinge fasteners mounted through the middle segment of the connecting hinge and the bottom mounting flange via the second strengthening frame to connect the middle segment of the connecting hinge securely with the second strengthening frame and the bottom mounting flange at the rear side of the cover.

3. The toolbox as claimed in claim 2, wherein each one of the multiple connecting hinges has a top segment formed with the middle segment of the connecting hinge at the rear side of the cover;

a bottom segment formed with the middle segment of the connecting hinge at the rear side of the casing;

two reinforcing sheets respectively formed on the bottom segment and the top segment of the connecting hinge and respectively abutting the rear sides of the casing and the cover;

multiple top fixing elements mounted through the reinforcing sheet that abuts the rear side of the cover, and the top fixing elements connected to the rear side of the cover; and multiple bottom fixing elements mounted through the reinforcing sheet that abuts the rear side of the casing, and the bottom fixing elements connected to the rear side of the casing.

4. The toolbox as claimed in claim 1, wherein the cover has a supporting element connected to the first strengthening frame and the second strengthening frame to provide a supporting effect to the cover relative to the casing, and the supporting element has two connecting arms pivotably connected to each other, and one of the two connecting arms is connected to the first strengthening frame at one of the opposite sides of the casing, and the other one of the connecting arms is connected to the second strengthening frame at one of the opposite sides of the cover that is corresponding to said one of the opposite sides of the casing.

5. The toolbox as claimed in claim 2, wherein the cover has a supporting element connected to the first strengthening frame and the second strengthening frame to provide a supporting effect to the cover relative to the casing, and the supporting element has two connecting arms pivotably connected to each other, and one of the two connecting arms is connected to the first strengthening frame at one of the opposite sides of the casing, and the other one of the connecting arms is connected to the second strengthening frame at one of the opposite sides of the cover that is corresponding to said one of the opposite sides of the casing.

6. The toolbox as claimed in claim 3, wherein the cover has a supporting element connected to the first strengthening frame and the second strengthening frame to provide a supporting effect to the cover relative to the casing, and the supporting element has two connecting arms pivotably connected to each other, and one of the two connecting arms is connected to the first strengthening frame at one of the opposite sides of the casing, and the other one of the connecting arms is connected to the second strengthening frame at one of the opposite sides of the cover that is corresponding to said one of the opposite sides of the casing.

7. The toolbox as claimed in claim 4, wherein the casing has two engaging rings securely mounted on the front side of the casing at a spaced interval; and the cover has two engaging protrusions securely mounted on the front side of the cover at a spaced interval and respectively and selectively engaging with the two engaging rings of the casing to hold the cover securely with the casing to close the top opening of the casing and the bottom opening of the cover.

8. The toolbox as claimed in claim 5, wherein the casing has two engaging rings securely mounted on the front side of the casing at a spaced interval; and the cover has two engaging protrusions securely mounted on the front side of the cover at a spaced interval and respectively and selectively engaging with the two engaging rings of the casing to hold the cover securely with the casing to close the top opening of the casing and the bottom opening of the cover.

9. The toolbox as claimed in claim 6, wherein the casing has two engaging rings securely mounted on the front side of the casing at a spaced interval; and the cover has two engaging protrusions securely mounted on the front side of the cover at a spaced interval and respectively and selectively engaging with the two engaging rings of the casing to hold the cover securely with the casing to close the top opening of the casing and the bottom opening of the cover.

10. The toolbox as claimed in claim 7, wherein each one of the first strengthening frame and the second strengthening frame is made of metal to increase the structural strength of the casing and the cover of the toolbox.

11. The toolbox as claimed in claim 8, wherein each one of the first strengthening frame and the second strengthening frame is made of metal to increase the structural strength of the casing and the cover of the toolbox.

12. The toolbox as claimed in claim 9, wherein each one of the first strengthening frame and the second strengthening frame is made of metal to increase the structural strength of the casing and the cover of the toolbox.

13. The toolbox as claimed in claim 1, wherein the casing has two engaging rings securely mounted on the front side of the casing at a spaced interval; and the cover has two engaging protrusions securely mounted on the front side of the cover at a spaced interval and respectively and selectively engaging with the two engaging rings of the casing to hold the cover securely with the casing to close the top opening of the casing and the bottom opening of the cover.

14. The toolbox as claimed in claim 2, wherein the casing has two engaging rings securely mounted on the front side of the casing at a spaced interval; and the cover has two engaging protrusions securely mounted on the front side of the cover at a spaced interval and respectively and selectively engaging with the two engaging rings of the casing to hold the cover securely with the casing to close the top opening of the casing and the bottom opening of the cover.

15. The toolbox as claimed in claim 3, wherein the casing has two engaging rings securely mounted on the front side of the casing at a spaced interval; and the cover has two engaging protrusions securely mounted on the front side of the cover at a spaced interval and respectively and selectively engaging with the two engaging rings of the casing to hold the cover securely with the casing to close the top opening of the casing and the bottom opening of the cover.

16. The toolbox as claimed in claim 1, wherein each one of the first strengthening frame and the second strengthening frame is made of metal to increase the structural strength of the casing and the cover of the toolbox.

17. The toolbox as claimed in claim 2, wherein each one of the first strengthening frame and the second strengthening frame is made of metal to increase the structural strength of the casing and the cover of the toolbox.

18. The toolbox as claimed in claim 3, wherein each one of the first strengthening frame and the second strengthening frame is made of metal to increase the structural strength of the casing and the cover of the toolbox.

* * * * *